US006824940B2

(12) United States Patent
Wu et al.

(10) Patent No.: US 6,824,940 B2
(45) Date of Patent: Nov. 30, 2004

(54) PHOTOCONDUCTIVE IMAGING MEMBERS

(75) Inventors: Jin Wu, Webster, NY (US); Markus R. Silvestri, Fairport, NY (US); Liang-Bih Lin, Webster, NY (US); Cindy C. Chen, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/369,812

(22) Filed: Feb. 19, 2003

(65) Prior Publication Data

US 2004/0161682 A1 Aug. 19, 2004

(51) Int. Cl.[7] ..... G03G 5/147

(52) U.S. Cl. ..... 430/66; 430/58.8; 430/59.5; 430/65; 430/124

(58) Field of Search ..... 430/66, 58.8, 59.5, 430/65, 124, 58.65, 59.4, 59.6, 64, 96

(56) References Cited

U.S. PATENT DOCUMENTS

| | | | | | |
|---|---|---|---|---|---|
| 3,121,006 | A | | 2/1964 | Middleton et al. | 96/1 |
| 4,265,990 | A | | 5/1981 | Stolka et al. | 430/59 |
| 4,555,463 | A | | 11/1985 | Hor et al. | 430/59 |
| 4,587,189 | A | | 5/1986 | Hor et al. | 430/59 |
| 4,921,769 | A | | 5/1990 | Yuh et al. | 430/64 |
| 5,473,064 | A | | 12/1995 | Mayo et al. | 540/141 |
| 5,482,811 | A | | 1/1996 | Keoshkerian et al. | 430/135 |
| 5,521,043 | A | | 5/1996 | Listogovers et al. | 430/59 |
| 6,015,645 | A | | 1/2000 | Murti et al. | 430/59 |
| 6,103,436 | A | * | 8/2000 | Yanus et al. | 430/58.8 |
| 6,156,468 | A | | 12/2000 | Wehelie et al. | 430/65 |
| 6,177,219 | B1 | | 1/2001 | Yuh et al. | 430/65 |
| 6,242,144 | B1 | * | 6/2001 | Lin et al. | 430/58.4 |
| 6,255,027 | B1 | | 7/2001 | Wehelie et al. | 430/65 |
| 6,287,737 | B1 | | 9/2001 | Ong et al. | 430/58.8 |

* cited by examiner

*Primary Examiner*—John L Goodrow
(74) *Attorney, Agent, or Firm*—E. O. Palazzo

(57) ABSTRACT

A photoconductive imaging member containing a hole blocking layer, a photogenerating layer, a charge transport layer, and thereover an overcoat layer comprised of a polymer with a low dielectric constant and charge transport molecules.

50 Claims, No Drawings

PHOTOCONDUCTIVE IMAGING MEMBERS

CROSS REFERENCES

There is illustrated in copending U.S. Ser. No. 10/370,186, entitled Photoconductive Imaging Members, filed concurrently herewith, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

There is illustrated in copending U.S. Ser. No. 10/369,816, the disclosure of which is totally incorporated herein by reference, filed concurrently herewith, entitled Photoconcluctive Imaging Members, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

There is illustrated in copending U.S. Ser. No. 10/369,798, the disolosure of which is totally incorporated herein by reference, filed concurrently herewith, entitled Photoconductive Imaging Members, a photoconductive imaging member comprised of an optional supporting substrate, a photogenerating layer, and a charge transport layer, and wherein said charge transport layer is comprised of a charge transport component and a polysiloxane.

RELATED PATENTS

Illustrated in U.S. Pat. No. 6,015,645, the disclosure of which is totally incorporated herein by reference, is a photoconductive imaging member comprised of a supporting substrate, a hole blocking layer, an optional adhesive layer, a photogenerator layer, and a charge transport layer, and wherein the blocking layer is comprised, for example, of a polyhaloalkylstyrene.

Illustrated in U.S. Pat. No. 6,287,737, the disclosure of which is totally incorporated herein by reference, is a photoconductive imaging member comprised of a supporting substrate, a hole blocking layer thereover, a photogenerating layer and a charge transport layer, and wherein the hole blocking layer is comprised of a crosslinked polymer derived from the reaction of a silyl-functionalized hydroxyalkyl polymer of Formula (I) with an organosilane of Formula (II) and water

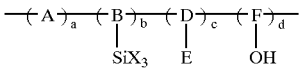

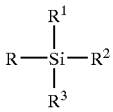

wherein A, B, D, and F represent the segments of the polymer backbone; E is an electron transporting moiety; X is selected from the group consisting of halide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide.

Illustrated in U.S. Pat. No. 5,473,064, the disclosure of which is totally incorporated herein by reference, is a process for the preparation of hydroxygallium phthalocyanine Type V, essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts $DI^3$, for each part of gallium chloride that is reacted; hydrolyzing the pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ballmilling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

Illustrated in U.S. Pat. No. 5,521,043, the disclosure of which is totally incorporated herein by reference, are photoconductive imaging members comprised of a supporting substrate, a photogenerating layer of hydroxygallium phthalocyanine, a charge transport layer, a photogenerating layer of BZP perylene, which is preferably a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10,21-dione, reference U.S. Pat. No. 4,587,189, the disclosure of which is totally incorporated herein by reference; and as a top layer a second charge transport layer.

The appropriate components and processes of the above patents may be selected for the present invention in embodiments thereof.

BACKGROUND

This invention is generally directed to imaging members, and more specifically, the present invention is directed to single and multi-layered photoconductive imaging members with a hole blocking or undercoat layer (UCL), a photogenerating layer, a charge transport layer, and an overcoating layer of, for example, a component with a low dielectric constant, such as from about or less than 2.5, and more specifically, a dielectric constant of from about 1 to about 2.5, and yet more specifically, from about 1.5 to about 2.3.

More specifically, the top layer of the imaging member of the present invention is comprised of a polymeric component with a low dielectric constant, examples of this component being poly(phenylene ether) (PPE), poly(cyclo olefin) (PCO), polyesters, polyamides, fluorinated polymers, and polyolefins with no ring structures present on the main polymeric chain, and charge transport molecules. The weight ratio of the polymer and charge transport molecules can be, for example, from about 30/70 to about 80/20. The polymer in embodiments possesses a glass transition temperature of from about 80° C. to about 260° C. (degrees Centigrade). Specific examples of PPE polymers are VESTORAN 1900™, a poly-2,6-dimethyl-1,4-phenylene ether polymer, available from Degussa, (temperature of deflection at 0.45 MPa load equal to 185° C. as determined with the known ASTM D648 testing method, and dielectric constant equal to 2 as determined with the known ASTM D150 at 1 MHz testing method), NORPEX AX290 PPE™, available from Ebbtide Polymers Corporation (temperature of deflection at 1.8 MPa equal to 143° C. (degrees Centigrade throughout) as determined with the known ASTM D648 testing method, and a dielectric constant equal to 2 as determined with the known ASTM D150 at 1 MHz testing method; specific examples of poly(cyclo olefin) polymers include ZEONOR 1600™, a polydicyclopentadiene polymer, available from Zeon Corporation (glass transition temperature equal to 163° C. as determined with DSC, dielectric constant equal to 2.3 as determined with ASTM D150 at 1 MHz testing method), ZEONEX E48R™, a polydicyclopentadiene polymer, available from Zeon Corporation (glass transition temperature equal to 140° C. as determined with DSC, dielectric constant equal to 2.3 as determined with the ASTM D150 at 1 MHz testing method); specific examples of polyesters include EASTAR AN004™, a poly(cyclohexylenedimethylene terephthalate) copolyester, available from Eastman Chemical (temperature of deflection at 0.45 MPa load equal to 103° C. as determined with the ASTM D648 testing method; dielectric constant equal to 2.1 as determined with the ASTM D150 at 1 MHz testing method); examples of polyamides include VESTAMIDE L1940™, a nylon 12, available from Creanova Inc. (temperature of deflection at 0.45 MPa load equal to 110° C. as determined with the ASTM D648 testing method; dielectric constant equal to 2 as determined with the ASTM D150 at 1 MHz testing method); examples of fluorinated polymers include DuPont 4100 FEP, a fluorinated ethylene propylene polymer (melting temperature equal to 259° C.; dielectric constant equal to 2 as determined with the ASTM D150 at 1 MHz testing method); examples of polyolefins with no ring structures on the main polymeric chain include VESTYRON 325™, a polystyrene, available from Creanova Inc. (glass transition temperature equal to 89° C. as determined with DSC; dielectric constant equal to 2 as determined with ASTM D150 at 1 MHz testing method), NOVOLEN 1102J™, a polypropylene, available from BASF (Viscat softening temperature equal to 92° C.; dielectric constant equal to 2.3 as determined with the ASTM D150 at 1 MHz testing method). The thickness of the overcoat layer in embodiments can be, for example, from about 0.1 micron to about 25 microns, more specifically from about 1 micron to about 10 microns, and yet more specifically from about 1 micron to about 5 microns.

In embodiments the hole blocking layer in contact with the supporting substrate can be situated between the supporting substrate and the photogenerating layer, which is comprised, for example, of the photogenerating pigments of U.S. Pat. No. 5,482,811, the disclosure of which is totally incorporated herein by reference, especially Type V hydroxygallium phthalocyanine, and generally metal free phthalocyanines, metal phthalocyanines, perylenes, titanyl phthalocyanines, selenium, selenium alloys, azo pigments, squaraines, and the like. The imaging members of the present invention in embodiments exhibit excellent cyclic/environmental stability, significantly improved BCR wear resistance and substantially no adverse changes in their performance over extended time periods since, for example, the imaging members comprise a mechanically robust and solvent resistant hole blocking layer, enabling the coating of a subsequent photogenerating layer thereon without structural damage. The photoresponsive, or photoconductive imaging members can be negatively charged when the photogenerating layers are situated between the hole transport layer and the hole blocking layer deposited on the substrate.

Processes of imaging, especially xerographic imaging and printing, including digital, are also encompassed by the present invention. More specifically, the layered photoconductive imaging members of the present invention can be selected for a number of different known imaging and printing processes including, for example, electrophotographic imaging processes, especially xerographic imaging and printing processes wherein charged latent images are rendered visible with toner compositions of an appropriate charge polarity. The imaging members are in embodiments sensitive in the wavelength region of, for example, from about 500 to about 900 nanometers, and in particular from about 650 to about 850 nanometers, thus diode lasers can be selected as the light source. Moreover, the imaging members of this invention are useful in color xerographic applications, particularly high-speed color copying and printing processes.

REFERENCES

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder.

The uses of perylene pigments as photoconductive substances are also known. There is thus described in Hoechst European Patent Publication 0040402, DE3019326, filed May 21, 1980, the use of N,N'-disubstituted perylene-3,4,9,10-tetracarboxyldiimide pigments as photoconductive substances. Specifically, there is, for example, disclosed in this publication N,N'-bis(3-methoxypropyl)perylene-3,4,9,10-tetracarboxyldiimide dual layered negatively charged photoreceptors with improved spectral response in the wavelength region of 400 to 700 nanometers. A similar disclosure is presented in Ernst Gunther Schlosser, *Journal of Applied Photographic Engineering*, Vol. 4, No. 3, page 118 (1978). There are also disclosed in U.S. Pat. No. 3,871,882, the disclosure of which is totally incorporated herein by reference, photoconductive substances comprised of specific perylene-3,4,9,10-tetracarboxylic acid derivative dyestuffs. In accordance with this patent, the photoconductive layer is preferably formed by vapor depositing the dyestuff in a vacuum. Also, there are disclosed in this patent dual layer photoreceptors with perylene-3,4,9,10-tetracarboxylic acid diimide derivatives, which have spectral response in the wavelength region of from 400 to 600 nanometers. Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methyl phenyl)-1,1'-biphenyl-4,4'-diamine dispersed in a polycarbonate binder as a hole transport layer. The above components, such as the photogenerating compounds and the aryl amine charge transport, can be selected for the imaging members of the present invention in embodiments thereof.

In U.S. Pat. No. 4,921,769, the disclosure of which is totally incorporated herein by reference, there are illustrated photoconductive imaging members with blocking layers of certain polyurethanes.

Illustrated in U.S. Pat. Nos. 6,255,027; 6,177,219, and 6,156,468, the disclosures of which are totally incorporated herein by reference, are, for example, photoreceptors containing a hole blocking layer of a plurality of light scattering particles dispersed in a binder, reference for example, Example 1 of U.S. Pat. No. 6,156,468, the disclosure of which is totally incorporated herein by reference, wherein there is illustrated a hole blocking layer of titanium dioxide dispersed in a specific linear phenolic binder of VARCUM, available from OxyChem Company.

SUMMARY

It is a feature of the present invention to provide imaging members with many of the advantages illustrated herein, such as preventing, or minimizing dark injection, a reduction in transit time, and wherein the resulting photoconducting members possess, for example, excellent photoinduced discharge characteristics, cyclic and environmental stability and acceptable charge deficient spot levels arising from dark injection of charge carriers. Furthermore, the electric field within the overcoat is increased or boosted, which in turn can alleviate the problem in applications that are mobility limited due to the low dielectric constant of the overcoat layer.

It is another feature of the present invention to provide a new two-layer architecture above the photogenerating layer, wherein the layer immediately above the photogenerating layer has a dielectric constant around 3 and the other layer (the overcoat layer) has a dielectric constant less than 2.5.

While not being desired to be limited by theory, when two layers, for example an overcoat layer on top of the charge transport layer, are coated with different permittivities $\epsilon_j$ (j=1 for top) and $\epsilon_1<\epsilon_2$, then for uniform charging to a given potential V, the electric field $E_1$ in the top layer is $$E_1 = \frac{V}{L\cdot\left(\alpha + (1-\alpha)\frac{\varepsilon_1}{\varepsilon_2}\right)}$$

where L is the total device thickness of the two layers and $\alpha L$ the thickness of the top layer. As a result, the field $E_1$ is boosted or increased with respect to the field in the lower layer, $E_2$, or with respect to the field that would result if the device contained only one layer. As a numeric example, a 5 $\mu$m overcoat layer with $\epsilon_1$ equal to 2 on top of a standard photoconductive device of 25 $\mu$m (permittivity $\epsilon_2$ equal to 3) should boost the electric field in the overcoat by about 38 percent.

This increase in electric field E will boost the mobility, and more importantly, assist in sweeping trailing carriers and reduce residual charges. In a number of instances, the approximation of $$\mu \approx \mu_0 e^{\beta\sqrt{E}}$$

is reasonable for fields that are not too low; hence, even small changes in the field may make a difference if $\beta$ is large enough. Here $\mu_0$ is the zero field mobility and $\beta$ is a materials constant that parameterizes the field dependence. At the field of $10^5$ V/cm, and assuming $\beta$=0.009 $(cm/V)^{0.5}$ for the field dependence this 38 percent boost in field results in a 65 percent increase in mobility. The final transit time $\tau$ is further decreased because of the coupling of the drift speed to the electric field $$\tau = \frac{L}{\mu\cdot E}$$

Hence, factoring in this last dependence, the total reduction of the transit time is about a factor of 2.4. Since the transit time is the time it takes the charges to pass through the layer, this 2.4 times faster performance can be very significant in applications where speed is desired.

Another feature of the present invention is the intrinsic improved wear life of the photoreceptor where less charge transport molecules are needed in the overcoat layer, thus resulting in longer wear life. Since the mobility of the overcoat (OCL) significantly increases when a low $\epsilon$ OCL ($\epsilon$<2.5) is applied on top of a conventional charge transport layer (CTL, $\epsilon$~3), it is possible to load less charge transport molecules (CTM) in the OCL to achieve general electrical requirements, and less CTM loading usually means better wear resistance.

Another feature of the present invention relates to the provision of layered photoresponsive imaging members, which are responsive to near infrared radiation of from about 700 to about 900 nanometers.

It is yet another feature of the present invention to provide layered photoresponsive imaging members with sensitivity to visible light.

Moreover, another feature of the present invention relates to the provision of layered photoresponsive imaging members with mechanically robust and solvent resistant hole blocking layers containing certain phenolic resin binders.

In a further feature of the present invention there are provided imaging members containing hole blocking polymer layers comprised of titanium oxide and a phenolic compound/phenolic resin blend, or a low molecular weight phenolic resin/phenolic resin blend, and which phenolic compounds containing at least two, and more specifically, two to ten phenolic groups or low molecular weight phenolic resins with a weight average molecular weight ranging from about 500 to about 2,000, can interact with and consume formaldehyde and other phenolic precursors within the phenolic resin effectively, thereby chemically modifying the curing processes for such resins and permitting, for example, a hole blocking layer with excellent efficient electron transport, and which usually results in a desirable lower residual potential and $V_{low}$.

Moreover, in another feature of the present invention there is provided a hole blocking layer comprised of titanium oxide, a phenolic resin/phenolic compound(s) blend or phenolic resin(s)/phenolic resin blend comprised of a first linear, or a first nonlinear phenolic resin and a second phenolic resin or phenolic compounds containing at least about 2, such as about 2, about 2 to about 12, about 2 to about 10, about 3 to about 8, about 4 to about 7, and the like, phenolic groups, and which blocking layer is applied to a drum of, for example, aluminum and cured at a high temperature of, for example, from about 135° C. to about 165° C.

Aspects of the present invention relate to a photoconductive imaging member comprised of a hole blocking layer, a photogenerating layer, a charge transport layer, and thereover an overcoat layer comprised of a polymer with a low dielectric constant and charge transport molecules; an imaging member wherein the weight ratio of the polymer and charge transport molecules is from about 30/70 to about 80/20; an imaging member wherein low is equal to or less than about 2.5; an imaging member wherein low is from about 1 to about 2; an imaging member wherein low is 2; an imaging member wherein the polymer (present in the top charge transport layer) is a poly(cyclo olefin); an imaging member wherein the polymer is a poly(phenylene ether); an imaging member wherein the polymer is a poly (cyclohexylenedimethylene terephthalate); an imaging member wherein the polymer is the poly(cyclo olefin) polymer of a polydicyclopentadiene; an imaging member wherein the polymer is the poly(phenylene ether) polymer of a poly-2,6-dimethyl-1,4-phenylene ether; an imaging member wherein the polymer is a fluorinated ethylene propylene polymer; an imaging member wherein the polymer is a poly[imino(1-oxododecamethylene)]; an imaging member wherein the polymer is a polystyrene; an imaging member wherein the polymer is a polypropylene; an imaging member wherein the charge transport molecules are selected from the group consisting of low dipole moment arylamine molecules wherein low is equal to or less than about 0 to about 3D; an imaging member wherein the charge transport molecules are comprised of bis(3,4-dimethylphenyl)-4-n-butylphenyl amine; an imaging member wherein the charge transport molecules are comprised of bis(3,4-dimethylphenyl)-4-sec-butylphenyl amine; an imaging member wherein the charge transport molecules are comprised of bis(3,4-dimethylphenyl)-4-t-butylphenyl amine; an imaging member wherein the charge transport molecules are comprised of bis(4-t-butylphenyl)-3,4-dimethylphenyl amine; an imaging member wherein the charge transport molecules are comprised of 1,1-bis(di-4-tolylaminophenyl)-4-tert-butylcyclohexane; an imaging member wherein the polymer (present in the top charge transport layer) possesses a glass transition temperature of from about 80° C. to about 260° C.; an imaging member wherein the polymer possesses a glass transition temperature of from about 160° C. to about 190° C.; an imaging member wherein the hole blocking layer is comprised of a mixture of a metal oxide and a phenolic resin; an imaging member wherein the metal oxide is a titanium oxide; an imaging member wherein the phenolic resin is selected from the group consisting of a formaldehyde polymer generated with phenol, p-tert-butylphenol and cresol; a formaldehyde polymer generated with ammonia, cresol and phenol; a formaldehyde polymer generated with 4,4'-(1-methylethylidene)bisphenol; a formaldehyde polymer generated with cresol and phenol; and a formaldehyde polymer generated with phenol and p-tert-butylphenol; an imaging member wherein the hole blocking layer is of a thickness of about 0.01 to about 30 microns; an imaging member wherein the hole blocking layer is of a thickness of from about 0.1 to about 8 microns; an imaging member and further containing an adhesive layer; an imaging member wherein the adhesive layer is comprised of a polyester with an $M_w$ of about 45,000 to about 75,000, and an $M_n$ of from about 30,000 about 40,000; an imaging member further containing a supporting substrate comprised of a conductive metal substrate of aluminum, aluminized polyethylene terephthalate or titanized polyethylene terephthalate; an imaging member wherein the photogenerator layer is of a thickness of from about 0.05 to about 10 microns, and wherein the transport layer is of a thickness of from about 10 to about 50 microns; an imaging member wherein the photogenerating layer is comprised of a photogenerating pigment or photogenerating pigments dispersed in a resinous binder, and wherein the pigment or pigments are present in an amount of from about 5 percent by weight to about 95 percent by weight, and wherein the resinous binder is selected from the group comprised of vinyl chloride/vinyl acetate copolymers, polyesters, polyvinyl butyrals, polycarbonates, polystyrene-b-polyvinyl pyridine, and polyvinyl formals; an imaging member wherein the charge transport layer comprises aryl amines, and which aryl amines are of the formula

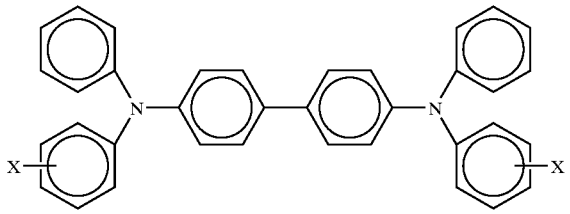

wherein X is selected from the group consisting of alkyl and halogen; an imaging member wherein alkyl contains from about 1 to about 10 carbon atoms; an imaging member wherein the aryl amine is N,N'-diphenyl-N,N-bis(3-methyl phenyl)-1,1'-biphenyl-4,4'-diamine; an imaging member wherein the photogenerating layer is comprised of metal phthalocyanines, or metal free phthalocyanines; an imaging member wherein the photogenerating layer is comprised of titanyl phthalocyanines, perylenes, or hydroxygallium phthalocyanines; an imaging member wherein the photogenerating layer is comprised of Type V hydroxygallium phthalocyanine; a method of imaging which comprises generating an electrostatic latent image on the imaging member, developing the latent image, and transferring the developed electrostatic image to a suitable substrate; an imaging member wherein the polymer overcoating layer is of a thickness of from about 0.1 to about 25 microns; an imaging member wherein the polymer overcoating layer is of a thickness of from about 1 to about 20 microns; an imaging member wherein the polymer overcoating layer is of a thickness of from about 5 to about 15 microns; an imaging member wherein the weight ratio of the polymer and charge transport molecules is from about 60/40 to about 75/25; an imaging member wherein the charge transport molecules in the polymer overcoating layer are comprised of aryl amines of the formula

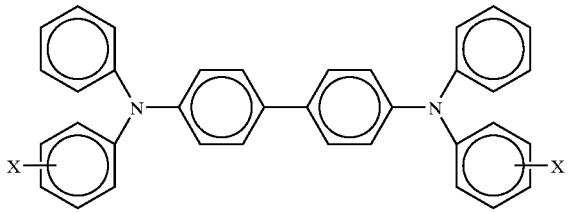

wherein X is selected from the group consisting of alkyl and halogen; an imaging member wherein the member comprises in sequence the photogenerating layer, the charge transport layer and the polymer overcoating layer, and optionally further containing a hole blocking layer in contact with a supporting substrate and an adhesive layer in contact with the hole blocking layer; a member comprised of a photogenerating layer, a charge transport layer, and thereover a layer comprised of a polymer with a low dielectric constant and a charge transport component.a photoconductive imaging member comprised of a supporting substrate, a hole blocking layer thereover, a photogenerating layer, a charge transport layer with a dielectric constant of from about 2.5 to about 3.5, and a top layer in contact with the charge transport layer, and which top layer is comprised of charge transport molecules and the low dielectric polymeric components illustrated herein, such as PPE, PCO and the like; a photoconductive imaging member comprised of a supporting substrate, a hole blocking layer thereover, a photogenerating layer and a charge transport layer with a dielectric constant of from about 2.5 to about 3, and a top layer in contact with the charge transport layer, and which top layer is comprised of charge transport molecules and the low dielectric polymeric components illustrated herein, such as PPE, PCO and the like, and wherein the hole blocking layer is comprised of a metal oxide dispersed in a blend of a phenolic compound and a phenolic resin, or a blend of two phenolic resins wherein the first resin possesses a weight average molecular weight of from about 500 to about 2,000 and the second resin possesses a weight average molecular weight of from about 2,000 to about 20,000, and a dopant, for example, of silicon oxide present in an amount of, for example, from about 2 to about 15 weight percent; or a hole blocking layer comprised of a titanium oxide, a dopant, such as a silicon oxide, a phenolic compound or compounds containing at least two, preferably about 2 to about 10 phenolic groups, such as bisphenol S and/or a phenolic resin having a weight average molecular weight of from about 500 to about 2,000, and a known phenolic resin, reference for example U.S. Pat. No. 6,177,219, the disclosure of which is totally incorporated herein by reference; a photoconductive imaging member wherein the top layer and the hole blocking layer are each of a thickness of about 0.01 to about 30 microns, and more specifically, are of a thickness of about 0.1 to about 8 microns; a photoconductive imaging member wherein the supporting substrate is comprised of a conductive metal substrate; a photoconductive imaging member wherein the conductive substrate is aluminum, aluminized polyethylene terephthalate, titanized polyethylene, and the like; a photoconductive imaging member wherein the photogenerator layer is of a thickness of from about 0.05 to about 10 microns; a photoconductive imaging member wherein the charge, such as hole transport layer, is of a thickness of from about 10 to about 50 microns; a photoconductive imaging member wherein the photogenerating layer is comprised of photogenerating pigments dispersed in an optional resinous binder in an amount of from about 5 percent by weight to about 95 percent by weight; a photoconductive imaging member wherein the photogenerating resinous binder is selected from the group consisting of copolymers of vinyl chloride, vinyl acetate and hydroxy and/or acid containing monomers, polyesters, polyvinyl butyrals, polycarbonates, polystyrene-b-polyvinyl pyridine, and polyvinyl formals; a photoconductive imaging member wherein the charge transport layer comprises aryl amine molecules; a photoconductive imaging wherein the charge transport aryl amines and the charge transport components contained in the top overcoating layer are, for example, of the formula

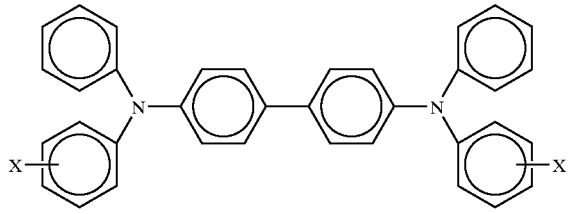

wherein X is selected from the group consisting of alkyl, alkoxy and halogen, and wherein the aryl amine is dispersed in a resinous binder; a photoconductive imaging member wherein the aryl amine alkyl is methyl or ethyl and wherein halogen is chloride or bromide, and wherein the resinous binder is selected from the group consisting of polycarbonates and polystyrene; a photoconductive imaging member wherein the aryl amine is N,N'-diphenyl-N,N-bis(3-methyl phenyl)-1,1'-biphenyl-4,4'-diamine, and related diamines; a photoconductive imaging member wherein the photogenerating layer is comprised of metal phthalocyanines, or metal free phthalocyanines, and the like; a photoconductive imaging member wherein the photogenerating layer is comprised of titanyl phthalocyanines, perylenes, alkylhydroxygallium phthalocyanines, hydroxygallium phthalocyanines, or mixtures thereof; a photoconductive imaging member wherein the photogenerating layer is comprised of Type V hydroxygallium phthalocyanine; a method of imaging which comprises generating an electrostatic latent image on the imaging member illustrated herein, developing the latent image, transferring the developed electrostatic image to a suitable substrate, and fixing the image; a photoconductive imaging member comprised of a hole blocking layer, a photogenerating layer, a charge transport layer, and a low dielectric top layer polymer as illustrated herein, and wherein the hole blocking layer is comprised of a metal oxide; an imaging member wherein the hole blocking layer phenolic compound is bisphenol S, 4,4'-sulfonyidiphenol; an imaging member wherein the phenolic compound is bisphenol A, 4,4'-isopropylidenediphenol; an imaging member wherein the phenolic compound is bisphenol E, 4,4'-ethylidenebisphenol; an imaging member wherein the phenolic compound is bisphenol F, bis(4-hydroxyphenyl) methane; an imaging member wherein the phenolic compound is bisphenol M, 4,4'-(1,3-phenylenediisopropylidene)bisphenol; an imaging member wherein the phenolic compound is bisphenol P, 4,4'-(1,4-phenylenediisopropylidene)bisphenol; an imaging member wherein the phenolic compound is bisphenol Z, 4,4'-cyclohexylidenebisphenol; an imaging member wherein the phenolic compound is hexafluorobisphenol A, 4,4'-(hexafluoroisopropylidene)diphenol; an imaging member wherein the phenolic compound is resorcinol, 1,3-benzenediol; an imaging member wherein the phenolic compound is hydroxyquinone, 1,4-benzenediol; an imaging member wherein the phenolic compound is of the formula

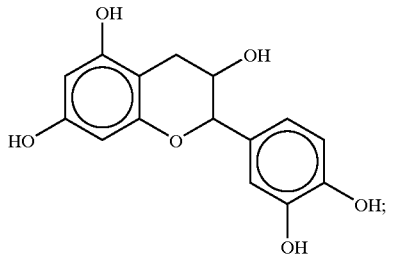

Catechin an imaging member wherein the phenolic resin is selected from the group consisting of a formaldehyde polymer generated with phenol, p-tert-butylphenol and cresol; a formaldehyde polymer generated with ammonia, cresol and phenol; a formaldehyde polymer generated with 4,4'-(1-methylethylidene)bisphenol; a formaldehyde polymer generated with cresol and phenol; and a formaldehyde polymer generated with phenol and p-tert-butylphenol; an imaging member comprised in sequence of a supporting substrate, a hole blocking layer, an optional adhesive layer, a photogenerating layer, a hole transport layer and an overcoating layer of the low dielectric constant components illustrated herein; an imaging member wherein the adhesive layer is comprised of a polyester with an $M_w$ of about 45,000 to about 75,000, and an $M_n$ of from about 30,000 about 40,000; an imaging member further containing a supporting substrate comprised of a conductive metal substrate of aluminum, aluminized polyethylene terephthalate or titanized polyethylene terephthalate; an imaging member wherein the photogenerator layer is of a thickness of from about 0.05 to about 10 microns, and wherein the transport layer is of a thickness of from about 10 to about 50 microns; an imaging member wherein the photogenerating layer is comprised of photogenerating pigments dispersed in a resinous binder in an amount of from about 10 percent by weight to about 90 percent by weight, and optionally wherein the resinous binder is selected from the group comprised of vinyl chloride/vinyl acetate copolymers, polyesters, polyvinyl butyrals, polycarbonates, polystyrene-b-polyvinyl pyridine, and polyvinyl formals; an imaging member wherein the charge transport layer comprises suitable known or future developed components, and more specifically aryl amines, and which aryl amines are of the formula

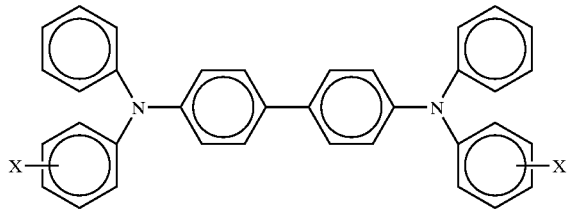

wherein X is selected from the group consisting of aryl, alkyl and halogen, and the like; an imaging member wherein the photogenerating layer is comprised of a hydroxygallium phthalocyanine; a method of imaging which comprises generating an electrostatic latent image on the imaging member illustrated herein, developing the latent image with a known toner, and transferring the developed electrostatic image to a suitable substrate like paper.

Examples of the top overcoating layer, which layer in embodiments is of a thickness, for example, of from about 0.1 to about 25, more specifically from about 1 to about 10, and yet more specifically from about 1 to about 5 microns, in contact with the charge transport or in embodiments the photogenerating layer, include a low dielectric constant ($\epsilon$<2.5) polymer and a charge transport molecule, or charge transport molecule mixtures with a weight ratio of, for example, from about 30/70 to about 80/20, more specifically from about 50/50 to about 75/25, and yet more specifically from about 60/40 to about 75/25. Polymer examples are amorphous poly(phenylene ethers), available from Creanova Inc. as VESTORAN 1900 PPE™ with a glass transition temperature, $T_g$, of 190° C. and a dielectric constant of 2; poly(cyclo olefins) PCOs available from Zeon Chemical as ZEONOR 1600™, with a $T_g$ of 163° C. and a dielectric constant of 2.27; heat resistant poly (cyclohexylenedimethylene terephthalates) PCTs available from Eastman Chemical as EASTAR AN004™ copolyesters with a temperature of deflection greater than 103° C. and a dielectric constant of 2.1; nylon 12 available from Creanova Inc. as VESTAMIDE L1940™ with a temperature of deflection equal to 110° C. and a dielectric constant equal to 2; fluorinated polymers available from E.I. DuPont Company as 4100 FEP™, a fluorinated ethylene propylene polymer with a melting temperature equal to 259° C. and a dielectric constant equal to 2; polystyrene available from Creanova Inc. as VESTYRON 325™ with a glass transition temperature equal to 89° C. and a dielectric constant equal to 2, and polypropylene available from BASF as NOVOLEN™ with a Viscat softening temperature equal to 92° C. and a dielectric constant equal to 2.3. Examples of the charge transport molecules are Ad-11 [bis(3,4-dimethylphenyl)-4-n-butylphenyl amine], Ad-1 [bis(3,4-dimethylphenyl)-4-sec-butylphenyl amine], Ae-22 [bis(3,4-dimethylphenyl)-4-t-butylphenyl amine], Ae-25 [bis(4-t-butylphenyl)-3,4-dimethylphenyl amine], tert-butylTAPC [1,1-bis(di-4-tolylaminophenyl)-4-tert-butylcyclohexane], of Formulas 1, 2, 3, 4 and 5, and the like. The selection of a specific charge transport molecule is determined by the compatibility with, for example, the polymer binder, and the solvents that used to dissolve the charge transport molecules and the polymer.

(1)

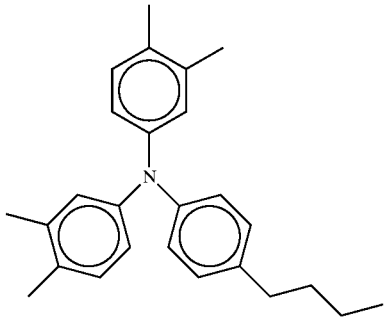

Ad-11

(2)

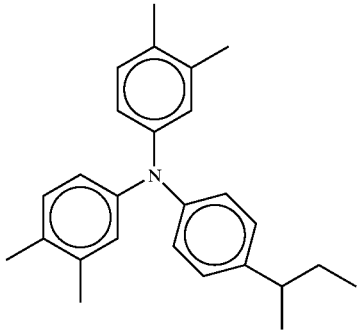

Ad-1

(3)

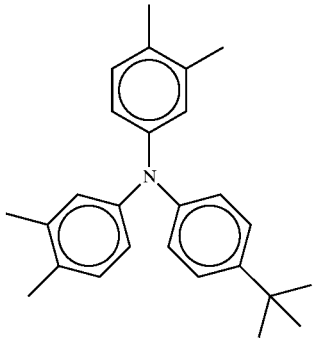

Ae-22

-continued (4)

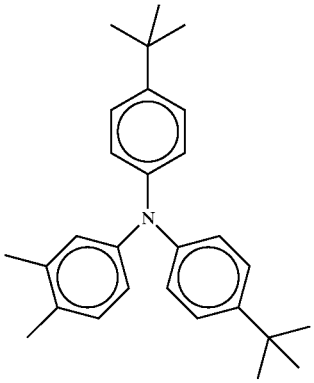

Ae-25

(5)

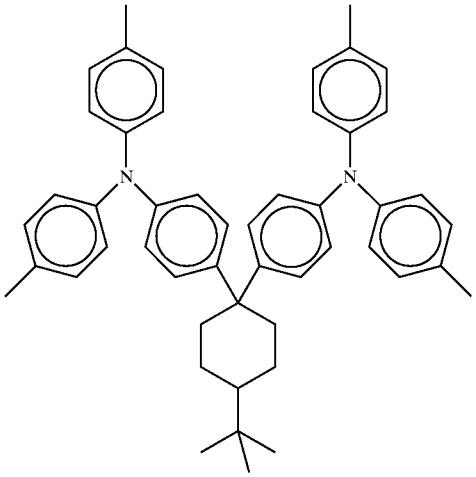

t-butylTAPC

Examples of common solvents are aromatic hydrocarbons, aliphatic hydrocarbons, halogenated hydrocarbons, ethers, amides and the like, or mixtures thereof. Specific examples are cyclohexanone, cyclohexane, chlorobenzene, carbon tetrachloride, chloroform, methylene chloride, trichloroethylene, tetrahydrofuran, dioxane, dimethyl formamide, dimethyl acetamide and the like, and which solvents can be selected in various amounts, such as from about 50 milliliters to about 1,000 milliliters.

In addition to the imaging member advantages illustrated herein, such as the selection of a low dielectric top overcoating layer of polymeric materials which are heat resistant, transparent or substantially transparent to light, less water permeable for less moisture sensitivity, thermally or UV curable, a reduced amount of charge transport molecules in the overcoated layer may be selected for excellent hole transport which results in excellent wear resistance for the member due to the reduced transit time within the low dielectric constant overcoat layer. Moreover, as illustrated herein the transit time of imaging members of the present invention in embodiments is reduced by, for example, a factor of about 2.4 when a 5 micron overcoat layer with a dielectric constant of 2 is placed on top of a 25 micron charge transport layer with a dielectric constant of 3. When the aforementioned device architecture remains the same with the 5 micron overcoat on top of 25 micron charge transport layer ($\epsilon$ equal to 3), and the dielectric constant of the overcoat layer varies from about 1.5 to about 2.3, the transit time of the imaging members of the present invention in embodiments is reduced by a factor of from about 4.1 to about 1.7 for a field of $10^5$ V/cm and a field dependence of $\beta=0.009\ (cm/V)^{0.5}$.

The hole blocking or undercoat layers for the imaging members of the present invention contain a number of components including known hole blocking components, such as silanes, doped metal oxides, a metal oxide like titanium, chromium, zinc, tin and the like, a mixture of phenolic compounds and a phenolic resin or a mixture of 2 phenolic resins, and optionally a dopant such as $SiO_2$. The phenolic compounds contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol; hydroxyquinone, catechin, and the like.

The hole blocking layer can be, for example, comprised of from about 20 weight percent to about 80 weight percent, more specifically, from about 55 weight percent to about 65 weight percent of a metal oxide, such as $TiO_2$; from about 20 weight percent to about 70 weight percent, more specifically, from about 25 weight percent to about 50 weight percent of a phenolic resin; from about 2 weight percent to about 20 weight percent, more specifically, from about 5 weight percent to about 15 weight percent of a phenolic compound preferably containing at least two phenolic groups, such as bisphenol S; and from about 2 weight percent to about 15 weight percent, more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 100 nanometers, for example from about 50 to about 90. To the above dispersion, a phenolic compound and dopant are added followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (OxyChem Company) and DURITE™ 97 (Borden Chemical), formaldehyde polymers with ammonia, cresol and phenol, such as VARCUM™ 29112 (OxyChem Company), formaldehyde polymers with 4,4'-(1-methylethylidene) bisphenol, such as VARCUM™ 29108 and 29116 (OxyChem Company), formaldehyde polymers with cresol and phenol, such as VARCUM™ 29457 (OxyChem Company), DURITE™ SD-423A, SD-422A (Borden Chemical), or formaldehyde polymers with phenol and p-tert-butylphenol, such as DURITE™ ESD 556C (Border Chemical).

Illustrative examples of substrate layers selected for the imaging members of the present invention, and which substrates can be opaque or substantially transparent, comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on many factors, including economical considerations, thus this layer may be of substantial thickness, for example over 3,000 microns, or of minimum thickness providing there are no significant adverse effects on the member. In embodiments, the thickness of this layer is from about 75 microns to about 300 microns.

The photogenerating layer, which can, for example, be comprised of hydroxygallium phthalocyanine Type V, is in embodiments comprised of, for example, about 60 weight percent of Type V and about 40 weight percent of a resin binder like polyvinylchloride vinylacetate copolymer such as VMCH (Dow Chemical). The photogenerating layer can contain known photogenerating pigments, such as metal phthalocyanines, metal free phthalocyanines, alkylhydroxyl gallium phthalocyanine, hydroxygallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder is present. Generally, the thickness of the photogenerator layer depends on a number of factors, including the thicknesses of the other layers and the amount of photogenerator material contained in the photogenerating layers. Accordingly, this layer can be of a thickness of, for example, from about 0.05 micron to about 10 microns, and more specifically, from about 0.25 micron to about 2 microns when, for example, the photogenerator compositions are present in an amount of from about 30 to about 75 percent by volume. The maximum thickness of this layer in embodiments is dependent primarily upon factors, such as photosensitivity, electrical properties and mechanical considerations. The photogenerating layer binder resin present in various suitable amounts, for example from about 1 to about 50, and more specifically, from about 1 to about 10 weight percent, may be selected from a number of known polymers such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The coating of the photogenerator layers in embodiments of the present invention can be accomplished with spray, dip or wire-bar methods such that the final dry thickness of the photogenerator layer is, for example, from about 0.01 to about 30 microns, and more specifically, from about 0.1 to about 15 microns after being dried at, for example, about 40° C. to about 150° C. for about 15 to about 90 minutes.

Illustrative examples of polymeric binder materials that can be selected for the photogenerator layer are as indicated herein, and include those polymers as disclosed in U.S. Pat. No. 3,121,006, the disclosure of which is totally incorporated herein by reference. In general, the effective amount of polymer binder that is utilized in the photogenerator layer ranges from about 0 to about 95 percent by weight, and preferably from about 25 to about 60 percent by weight of the photogenerator layer.

As optional adhesive layers usually in contact with the hole blocking layer, there can be selected various known substances inclusive of polyesters, polyamides, poly(vinyl butyral), poly(vinyl alcohol), polyurethane and polyacrylonitrile. This layer is, for example, of a thickness of from about 0.001 micron to about 1 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present invention further desirable electrical and optical properties.

Aryl amines selected for the charge, especially the charge transport layer, and for the overcoating top layer present as a mixture with the polymer in the top layer, and wherein the charge transport layer generally is of a thickness of from about 5 microns to about 75 microns, and more specifically, of a thickness of from about 10 microns to about 40 microns, include molecules of the following formula

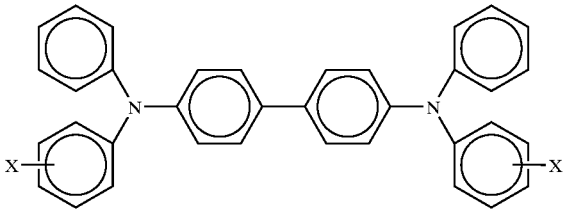

dispersed in a highly insulating and transparent polymer binder, wherein X is an alkyl group, aryl, a halogen, or mixtures thereof, especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example, U.S. Pat. Nos. 4,921,773 and 4,464,450, the disclosures of which are totally incorporated herein by reference.

Examples of the binder materials for the transport layers include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes, poly(cyclo olefins), and epoxies as well as block, random or alternating copolymers thereof. Preferred electrically inactive binders are comprised of polycarbonate resins with a molecular weight of from about 20,000 to about 100,000 with a molecular weight $M_w$ of from about 50,000 to about 100,000 being particularly preferred. Generally, the transport layer contains from about 10 to about 75 percent by weight of the charge transport material, and more specifically, from about 35 percent to about 50 percent of this material.

Also included within the scope of the present invention are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same aforementioned sequence with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated. Comparative Examples and data are also provided.

EXAMPLE I

Photoreceptor devices (P/R devices) or imaging members were fabricated with the following architectures in the sequence from bottom to top: undercoat layer, photogenerating layer, charge transport layer with a dielectric constant of about 3 and an overcoat layer with a dielectric constant of about 2.3.

The undercoat layer was prepared as follows. A titanium oxide/phenolic resin dispersion was prepared by ball milling 15 grams of titanium dioxide (STR60N™, Sakai Company), 20 grams of the phenolic resin (VARCUM™ 29159, OxyChem Company, $M_w$ of about 3,600, viscosity of about 200 cps) in 7.5 grams of 1-butanol, and 7.5 grams of xylene with 120 grams of 1 millimeter diameter sized $ZrO_2$ beads for 5 days. Separately, a slurry of $SiO_2$ and a phenolic resin was prepared by adding 10 grams of $SiO_2$ (P100, Esprit) and 3 grams of the above phenolic resin into 19.5 grams of 1-butanol and 19.5 grams of xylene. The resulting titanium dioxide dispersion was filtered with a 20 micrometer pore size nylon cloth, and then the filtrate was measured with Horiba Capa 700 Particle Size Analyzer, and there was obtained a median $TiO_2$ particle size of 50 nanometers in diameter and a $TiO_2$ particle surface area of 30 $m^2$/gram with reference to the above $TiO_2$/VARCUM™ dispersion. Additional solvents of 5 grams of 1-butanol, and 5 grams of xylene; 2.6 grams of bisphenol S (4,4'-sulfonyidiphenol), and 5.4 grams of the above prepared $SiO_2$/VARCUM™ slurry were added to 50 grams of the above resulting titanium dioxide/VARCUM™ dispersion, referred to as the coating dispersion. A 30 millimeters in diameter and 340 millimeters in length aluminum pipe cleaned with detergent and rinsed with deionized water was dip coated with the coating dispersion at a pull rate of 160 millimeters/minute, and subsequently, dried at 160° C. for 15 minutes, which resulted in an undercoat layer (UCL) comprised of $TiO_2$/$SiO_2$/VARCUM™/bisphenol S with a weight ratio of about 52.7/3.6/34.5/9.2 and a thickness of 3.5 microns.

A 0.5 micron thick photogenerating layer was subsequently coated on top of the above generated undercoat layer from a dispersion of chlorogallium phthalocyanine Type B (3 parts), and a vinyl chloride/vinyl acetate copolymer, VMCH ($M_n$ equal to 27,000, about 86 weight percent of vinyl chloride, about 13 weight percent of vinyl acetate and about 1 weight percent of maleic acid) available from Dow Chemical (2 parts), in 95 grams of toluene/n-butylacetate with a weight ratio of 2 to 1. Subsequently, a 24 $\mu$m thick charge transport layer (CTL/SMTL) was coated on top of the photogenerating layer from a solution of N,N'-diphenyl-N,N-bis(3-methyl phenyl)-1,1'-biphenyl-4,4'-diamine (8.8 parts) and a polycarbonate, PCZ-400 [poly(4,4'-dihydroxydiphenyl-1-1-cyclohexane, $M_w$ equal to 40,000)] available from Mitsubishi Gas Chemical Company, Ltd. (13.2 parts) in a mixture of 55 grams of tetrahydrofuran (THF) and 23.5 grams of toluene. The CTL was dried at 120° C. for 45 minutes.

The overcoat layer was prepared as following. The overcoat solution was ring coated on top of the CTL (charge transport layer), and which solution was comprised of ZEONOR 1600™ (Zeon Chemicals, Tg equal to 163° C., $\epsilon$ equal to 2.3), Ad-1 (synthesized by the Xerox Research Centre of Canada), and hole transport molecules of [bis(3,4-dimethylphenyl)-4-sec-butylphenyl amine] with a weight ratio of 75/25 in cyclohexane and with a solid content of about 11 weight percent. The overcoat layer was dried at 120° C. for 30 minutes. Devices were prepared with an overcoat thickness of 3 and 5 microns.

The above devices were electrically tested with an electrical scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The devices were tested at surface potentials of 500 volts with the exposure light intensity incrementally increased by means of regulating a series of neutral density filters; the exposure light source was a 780 nanometer light emitting diode. The xerographic simulation was completed in an environmentally controlled light tight chamber at ambient conditions (40 percent relative humidity and 22° C.). The following table summarizes the electrical performance for these devices.

| Device | $V_{low}$ of 4.26 erg/cm$^2$ Exposure Energy and 166 ms Charge to Exposure Delay (V) | dV/dx | $V_{depletion}$ (V) |
|---|---|---|---|
| No Overcoat | 117 | 138 | 20 |
| 3 Micron Overcoat | 140 | 141 | 22 |
| 5 Micron Overcoat | 139 | 140 | 26 |

$V_{low}$ is the surface potential of the device subsequent to a certain light exposure at a certain time delay after the exposure; dV/dx is the initial slope of the PIDC curve and is a measurement of sensitivity; and $V_{depletion}$ is linearly extrapolated from the surface potential versus charge density relation of the device and is a measurement of voltage leak during charging. $V_{low}$ of the overcoated device is independent of the overcoat thickness ($V_{low}$ of the 3 micron overcoat device is equal to 140 volts, which is close to that of the 5 micron overcoat device equal to 139 volts), and generally 20 volts higher than the device without overcoat ($V_{low}$ of the non-overcoat device is equal to 117 volts). Other electrical characteristics, such as dV/dx and $V_{depletion}$, remain substantially unchanged for the overcoated devices and non-overcoated device.

The wear rate of the overcoated device was tested with a BCR (biased charging roll) wear fixture. The wear rate was estimated to be about 50 nanometers/kcycle, which is significantly smaller than that of the control device without the overcoat (~90 nanometers/kcycle).

EXAMPLE II

This Example relates to the generation of belt photoreceptors.

Aluminized polyethylene terephthalate substrates were used, on top of which a silane blocking layer (BLS) was coated in glove box at a humidity of less than about 30 percent, for example 27 percent, using 0.0005" Bird Bar. The BLS was prepared by mixing distilled water (5 parts) and 3-aminopropyl triethoxysilane (1 part) for 4 hours, and then adding acetic acid (0.3 part), ethanol (78.7 parts) and heptane (20 parts) in sequence every other 10 minutes. The BLS was dried at 120° C. for 1 minute, and the final coating thickness was estimated to be about 50 nanometers.

An adhesive interface layer (IFL), comprised of a polyester with a $M_w$ of about 49,000 in THF/cyclohexanone (70/30 weight/weight), was then coated on top of the BLS in a protective hood with 0.0005" Bird bar. The IFL was dried at 120° C. for 1 minute, and the final coating thickness was estimated to be about 50 nanometers.

A charge generator layer (BGL, binder generator layer) was then coated on top of the IFL in the above hood with a 0.00025" Bird Bar. The BGL was prepared by roll milling a mixture of hydroxygallium phathalocyanine (Type V, 1.33 parts), polystyrene-co-poly(vinyl pyridine) (ASVP1811, 1.5 parts), toluene (44.33 parts) and stainless steel shot at 200 rpm for 20 hours. The BGL was dried at 120° C. for 1 minute, and the final coating thickness was estimated to be about 0.4 micron, and which coating had an optical density of from about 0.8 to about 1 at 670 nanometers.

A charge transport layer (CTL/SMTL) comprised of MAKROLON® polycarbonate A (10 parts), N,N'-diphenyl-N,N-bis(3-methyl phenyl)-1,1'-biphenyl-4,4'-diamine (10 parts) and methylene chloride (113 parts) was then coated on top of the above BGL in a glove box with 6" wide, 4 mil Bird Bar to 24 microns in thickness. The SMTL was dried at ambient conditions for 3 to 5 minutes and then 120° C. for 1 minute.

The overcoat layer (OCL) was then coated on top of the above SMTL in a glove box with 6" wide, 4 mil Bird Bar to 10 microns in thickness. The OCL was dried at ambient conditions for 3 to 5 minutes and then at 135° C. for 10 minutes. The OCL was prepared by dissolving NORPEX AX 290 PPE™ (Ebbtide Polymers Corporation, temperature of deflection equal to 143° C., $\epsilon$ equal to 2), Ad-11 (synthesized by the Xerox Research Centre of Canada), and hole transporting components of [bis(3,4-dimethylphenyl)-4-n-butylphenyl amine] with a weight ratio of 70/30 in chlorobenzene.

It is believed that the photoreceptor of the above Example II will possess a number of the desirable characteristics as recited herein.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A photoconductive imaging member comprised in sequence of a hole blocking layer, a photogenerating layer, a charge transport layer, and thereover an overcoat layer comprised of a polymer with a low dielectric constant from about or less than 2.5 and charge transport molecules, and wherein said member possesses acceptable charge transist time characteristics.

2. An imaging member in accordance with claim 1 wherein the weight ratio of the polymer and charge transport molecules is from about 30/70 to about 80/20.

3. An imaging member in accordance with claim 1 wherein said low is equal to or less than about 2.5.

4. An imaging member in accordance with claim 1 wherein said low is from about 1 to about 2.5.

5. An imaging member in accordance with claim 1 wherein said low is 2.

6. An imaging member in accordance with claim 1 wherein said polymer is a poly(cyclo olefin).

7. An imaging member in accordance with claim 1 wherein said polymer is a poly(phenylene ether).

8. An imaging member in accordance with claim 1 wherein said polymer is a poly(cyclohexylenedimethylene terephthalate).

9. An imaging member in accordance with claim 1 wherein said polymer is the poly(cyclo olefin) polymer of a polydicyclopentadiene.

10. An imaging member in accordance with claim 1 wherein said polymer is the poly(phenylene ether) polymer of a poly-2,6-dimethyl-1,4-phenylene ether.

11. An imaging member in accordance with claim 1 wherein said polymer is a fluorinated ethylene propylene polymer.

12. An imaging member in accordance with claim 1 wherein said polymer is a poly[imino(1-oxododecamethylene)].

13. An imaging member in accordance with claim 1 wherein said polymer is a polystyrene.

14. An imaging member in accordance with claim 1 wherein said polymer is a polypropylene.

15. An imaging member in accordance with claim 1 wherein said charge transport molecules are comprised or bis(3,4-dimethylphenyl)-4-n-butylphenyl amine.

16. An imaging member in accordance with claim 1 wherein said charge transport molecules are comprised of bis(3,4-dimethylphenyl)-4-sec-butylphenyl amine.

17. An imaging member in accordance with claim 1 wherein said charge transport molecules are comprised of bis(3,4-dimethylphenyl)-4-t-butylphenyl amine.

18. An imaging member in accordance with claim 1 wherein said charge transport molecules are comprised of bis(4-t-butylphenyl)-3,4-dimethylphenyl amine.

19. An imaging member in accordance with claim 1 wherein said charge transport molecules are comprised of 1,1-bis(di-4-tolylaminophenyl)-4-tert-butylcyclohexane.

20. An imaging member in accordance with claim 1 wherein said polymer possesses a glass transition temperature of from about 80° C. to about 260° C.

21. An imaging member in accordance with claim 1 wherein said polymer possesses a glass transition temperature of from about 160° C. to about 190° C.

22. An imaging member in accordance with claim 1 wherein said hole blocking layer is comprised of a mixture of a metal oxide and a phenolic resin.

23. An imaging member in accordance with claim 22 wherein said metal oxide is a titanium oxide.

24. An imaging member in accordance with claim 22 wherein said phenolic resin is selected from the group consisting of a formaldehyde polymer generated with phenol, p-tert-butylphenol and cresol; a formaldehyde polymer generated with ammonia, cresol and phenol; a formaldehyde polymer generated with 4,4'-(1-methylethylidene) bisphenol; a formaldehyde polymer generated with cresol and phenol; and a formaldehyde polymer generated with phenol and p-tert-butylphenol.

25. An imaging member in accordance with claim 1 wherein said hole blocking layer is of a thickness of about 0.01 to about 30 microns.

26. An imaging member in accordance with claim 1 wherein said hole blocking layer is of a thickness of from about 0.1 to about 8 microns.

27. An imaging member in accordance with claim 1 and further containing an adhesive layer.

28. An imaging member in accordance with claim 27 wherein the adhesive layer is comprised of a polyester with an $M_w$ of about 45,000 to about 75,000, and an $M_n$ of from about 30,000 about 40,000.

29. An imaging member in accordance with claim 1 further containing a supporting substrate comprised of a conductive metal substrate of aluminum, aluminized polyethylene terephthalate or titanized polyethylene terephthalate.

30. An imaging member in accordance with claim 1 wherein said photogenerator layer is of a thickness of from about 0.05 to about 10 microns, and wherein said transport layer is of a thickness of from about 10 to about 50 microns.

31. An imaging member in accordance with claim 1 wherein the photogenerating layer is comprised of a photogenerating pigment or photogenerating pigments dispersed in a resinous binder, and wherein said pigment or pigments are present in an amount of from about 5 percent by weight to about 95 percent by weight, and wherein the resinous, binder is selected from the group comprised of vinyl chloride/vinyl acetate copolymers, polyesters, polyvinyl butyrals, polycarbonates, polystyrene-b-polyvinyl pyridine, and polyvinyl formals.

32. An imaging member in accordance with claim 1 wherein the charge transport layer comprises aryl amines, and which aryl amines are of the formula

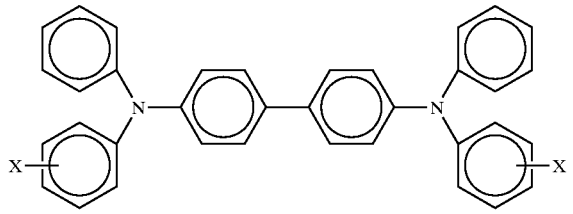

wherein X is selected from the group consisting of alkyl and halogen.

33. An imaging member in accordance with claim 32 wherein alkyl contains from about 1 to about 10 carbon atoms.

34. An imaging member in accordance with claim 32 wherein the aryl amine is N,N4'-diphenyl-N,N-bis(3-methyl phenyl)-1,1'-biphenyl-4,4'-diamine.

35. An imaging member in accordance with claim 1 wherein the photogenerating layer is comprised of metal phthalocyanines, or metal free phthalocyanines.

36. An imaging member in accordance with claim 1 wherein the photogenerating layer is comprised of titanyl phthalocyanines, perylenes, or hydroxygallium phthalocyanines.

37. An imaging member in accordance with claim 1 wherein the photogenerating layer is comprised of Type V hydroxygallium phthalocyanine.

38. A method of imaging which comprises generating an electrostatic latent image on the imaging member of claim 1, developing the latent image, and transferring the developed electrostatic image to a suitable substrate.

39. An imaging member in accordance with claim 1 wherein said polymer overcoat layer is of a thickness of from about 0.1 to about 25 microns.

40. An imaging member in accordance with claim 1 wherein said polymer overcoating layer is of a thickness of from about 1 to about 20 microns.

41. An imaging member in accordance with claim 1 wherein said polymer overcoating layer is of a thickness of from about 5 to about 15 microns.

42. An imaging member in accordance with claim 1 wherein the weight ratio of the polymer and charge transport molecules is from about 60/40 to about 75/25.

43. An imaging member in accordance with claim 1 wherein said charge transport molecules in the polymer overcoat layer are comprised of aryl amines of the formula

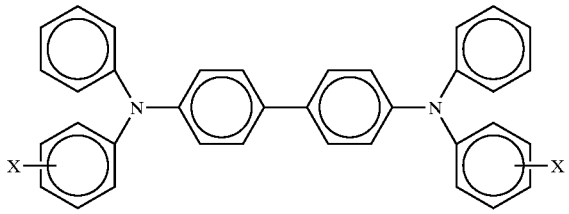

wherein X is selected from the group consisting of alkyl and halogen.

44. An imaging member in accordance with claim 1 wherein said member comprises in sequence said photogenerating layer, said charge transport layer and said polymer overcoating layer, and optionally further containing a hole blocking layer in contact with a supporting substrate and an adhesive layer in contact with the hole blocking layer.

45. A member comprised of a photogenerating layer, a charge transport layer, and thereover a layer comprised of a polymer with a low dielectric constant from about or less than 2.5 and a charge transport component.

46. A member comprised of a supporting substrate, a photogenerating layer, a charge transport layer, and in contact with said charge transport layer a polymer and a charge transport component, and wherein said polymer possesses a suitable dielectric constant from about or less than 2.5 and a suitable charge transit time.

47. A member in accordance with claim 46 wherein said charge transport is comprised of hole transport molecules; said charge transport component is comprised of hole transport molecules, and said charge transport layer is situated between said photogenerating layer and said polymer containing layer.

48. A photoconductive imaging member comprised of a hole blocking layer, a photogenerating layer, a charge transport layer, and thereover an overcoat layer comprised of a polymer with a low dielectric constant from about or less than 2.5 and charge transport molecules, and wherein said polymer is a poly(cyclo olefin).

49. An imaging member in accordance with claim 48 wherein said poly(cyclo olefin) is a polymer of a polydicyclopentadiene.

50. A member in accordance with claim 1 wherein the transit time is decreased, and wherein the electric field, $E_1$ in the top layer is $$E_1 = \frac{V}{L \cdot \left(\alpha + (1-\alpha)\frac{\varepsilon_1}{\varepsilon_2}\right)}$$

where V represents the potential, L is the thickness of the charge transport layer and the top layer, and $\alpha L$ the thickness of the top layer resulting in said field $E_1$ being increased with respect to the field in the charge transport layer, $E_2$, and wherein said increase in electric field E increases the the mobility of charges.

* * * * *